US008233652B2

(12) United States Patent
Jørgensen et al.

(10) Patent No.: US 8,233,652 B2
(45) Date of Patent: Jul. 31, 2012

(54) DETACHABLE EARPIECE AUDITORY DEVICE WITH SPRING OPERATION

(75) Inventors: Martin Bondo Jørgensen, Vaerløse (DK); Niels Thor Møller, Borup (DK)

(73) Assignee: Sonion A/S, Roskilde (DK)

( * ) Notice: Subject to any disclaimer, the term of this patent is extended or adjusted under 35 U.S.C. 154(b) by 807 days.

(21) Appl. No.: 12/334,945

(22) Filed: Dec. 15, 2008

(65) Prior Publication Data

US 2009/0154749 A1 Jun. 18, 2009

Related U.S. Application Data

(60) Provisional application No. 61/007,668, filed on Dec. 14, 2007.

(51) Int. Cl.
*H04R 25/00* (2006.01)

(52) U.S. Cl. ..... 381/322; 381/324; 381/328

(58) Field of Classification Search ..... 381/322–324, 381/328, 329

See application file for complete search history.

(56) References Cited

U.S. PATENT DOCUMENTS

| | | | | |
|---|---|---|---|---|
| 7,110,562 | B1 | 9/2006 | Feeley et al. | 381/322 |
| 2005/0190940 | A1 | 9/2005 | Ach-Kowalewski et al. | 381/330 |
| 2006/0159298 | A1 * | 7/2006 | von Dombrowski et al. | 381/330 |
| 2007/0009130 | A1 | 1/2007 | Feeley et al. | 381/330 |

FOREIGN PATENT DOCUMENTS

| | | | |
|---|---|---|---|
| DE | 10 2004 044 318 | B3 | 11/2005 |
| DE | 20 2005 012 668 | U1 | 12/2006 |
| EP | 1 681 904 | A1 | 7/2006 |
| EP | 1 816 893 | A1 | 8/2007 |

OTHER PUBLICATIONS

European Search Report for Application No. EP 08171543.5 dated Oct. 26, 2009 (7 pages).

* cited by examiner

*Primary Examiner* — Matthew E Warren
(74) *Attorney, Agent, or Firm* — Nixon Peabody LLP

(57) ABSTRACT

A detachable earpiece auditory device comprises a housing, a speaker, and a connector. The housing has a sound outlet, a second opening, and a spring element positioned at the second opening. The speaker is provided within the housing and comprises an electrically conducting speaker terminal at an outer surface of the speaker. The connector comprises a first insert part, an electrically conducting connector terminal, and a second insert part. The first insert part is insertable into the second opening. The electrically conducting connector terminal is positioned in the first insert part to obtain electrical contact with the electrically conducting speaker terminal and forms a mating pair of a speaker terminal and a connector terminal when the first insert part is inserted into the second opening. The second insert part operatively contacts the spring element to bias the speaker terminal against the connector terminal with a predetermined bias force.

14 Claims, 2 Drawing Sheets

DETACHABLE EARPIECE AUDITORY DEVICE WITH SPRING OPERATION

RELATED APPLICATION DATA

This application is a nonprovisional application of U.S. Provisional Application No. 61/007,668, filed Dec. 14, 2007, which is incorporated herein by reference.

FIELD OF THE INVENTION

The present invention relates to a detachable earpiece device detachably attached to a connector in a manner preferably without soldering/welding but using only a spring connection.

BACKGROUND OF THE INVENTION

Detachable auditory earpiece devices are known in the art and may be seen, for example, in U.S. Publication No. 2007/0009130.

SUMMARY OF THE INVENTION

In a first aspect, the invention relates to a detachable earpiece auditory device comprising a housing, a speaker, and a connector. The housing has a sound outlet, a second opening, and a spring element positioned at the second opening. The speaker is provided within the housing and comprises an electrically conducting speaker terminal at an outer surface of the speaker. The connector comprises a first insert part, an electrically conducting connector terminal, and a second insert part. The first insert part is insertable into the second opening. The electrically conducting connector terminal is positioned in the first insert part and is arranged to obtain electrical contact with the electrically conducting speaker terminal so as to form a mating pair of a speaker terminal and a connector terminal when the first insert part is inserted into the second opening. The second insert part is in operative contact with the spring element so as to bias the speaker terminal against the connector terminal with a predetermined bias force.

In the present context, an earpiece auditory device may be any type of device adapted to provide sound to the ear of a person, but the invention is primarily focused on miniature elements for positioning at or in the auditory canal of a persons ear, such as is desired in earphones, headphones, headsets, monitors, IFB devices, so-called RIC hearing aids as well as earplugs.

In the present context, a speaker is a moving coil speaker or a moving armature receiver for, example a balanced moving armature receiver. The receiver/housing is connectable to the connector by way of the spring elements so that no soldering or welding is required, and the receiver/housing is detachable there from, preferably only due to disengagement of the spring elements, without requiring soldering/welding operations.

In this context, the spring elements are preferably integrally formed with the housing, such as one or more finger structure(s) punched out or cut out of the housing material adjacent to the second opening. Thus, the spring elements may be made of a material itself being flexible. According to a preferred embodiment, the housing is formed in a metallic material having a sufficient spring action (stiffness) even with a very small thickness.

The housing has a sound outlet for transmitting sound generated by the speaker towards the user's ear canal. Naturally, the speaker need not be fully inserted within the housing. For example, the speaker, having a sound output, may have a part with the speakers sound output extending out of the sound output of the housing, so that the sound actually is emitted from the speaker directly to the surroundings.

In the present context, a terminal is an electrically conducting element or surface. Mating terminals are terminals in electrical contact, such as by direct contact between their terminal surfaces.

The individual positions of the terminals of the speaker and/or the connector, if more than a single is present in each element, preferably is so that all pairs of a speaker terminal and a connector terminal will mate when the first part is received in the second opening.

In this context, the bias force exerted by the spring element (s) on the second part will bias the speaker terminal(s) and the connector terminal(s) against each other to facilitate mating and thus electrical contact. In this connection, this biasing force preferably is in a direction of insertion of the first part into the housing, which direction suitably is a longitudinal axis of the housing.

Naturally, the second part of the connector may also partly or fully be received or receivable within the housing.

In one embodiment, the second part is adapted to engage with the spring element(s) so as to bias the connector toward the housing, such as along a longitudinal direction of the housing and/or a direction of introduction of the first part of the connector in the housing.

In general, the housing and connector, such as the second part thereof, may be shaped so as to form an at least substantially closed surface in order to prevent dust, dirt, earwax, water and the like from entering the housing via the second opening.

In the above or another embodiment, the speaker terminal (s) and/or the connector terminal(s) is/are resilient, deformable or translatable in a direction of the predetermined bias force. This deformability or translatability may be obtained by providing one or more of the terminals as deformable elements (foam, spring, conducting plastics, or the like) or by using spring elements or the like for forcing one terminal of a pair toward the other terminal of the pair. Then, the speaker, for example, may have its terminal(s) shaped as U-shaped electrical conductors adapted to be biased toward the speaker during mating with the corresponding terminal(s) of the connector. In this manner, the predetermined bias force will ensure constant and reliable electrical connection even during impact shocks or rapid movement of the earpiece auditory device.

In general, the connector may be connected to a cable or other connecting means again connected or connectable to an element adapted to provide an electrical signal for the speaker via the cable and connector. In this situation, the cable/connector may be detached from the housing/speaker for, for example, replacing a defect speaker. In this manner, the user need not return the entire communication device for service or repair, but only the earpiece auditory device, or maybe even need to replace only the speaker itself.

In a preferred embodiment, the first and second insert parts form part of a unitary structure created by insert moulding together with the electrically conducting connector terminal so as to form a monolithic connector. This facilitates production of the connector.

Preferably, the earpiece auditory device further comprises an acoustical sealing ring in abutment to the first and second insert parts and positioned adjacent to the second opening to acoustically seal an interior of the housing toward the external environment. This provides acoustic shielding of sound from the outside entering the housing and sound from the inside of the housing exiting in the wrong direction such as in the direction of a microphone.

A particularly interesting embodiment is one wherein the connector additionally comprises an acoustic channel having a first opening in the first part and a second opening in the second part. The housing additionally comprises an acoustic path between the second opening and the sound output. In this embodiment, sound input through the first opening will travel through the connector into the second opening and further, inside the housing, to the sound output. This sound input into the first opening may be transmitted thereto via a cable or the like also carrying electrical signals to the terminals, and may be generated by a second, more remote speaker. In this manner, the speaker in the housing, which speaker normally is desired to be quite small, may be a high-frequency speaker (tweeter), and the remote speaker positioned outside the housing, where size therefore is less critical, a low-frequency speaker (woofer). This is advantageous as low frequency sound, such as sound in the frequency range 20 Hz-500 Hz, propagates through sound tubes or conductors without noticeable attenuation or distortion compared to high-frequency sound, such as sound in the frequency range 1 kHz-20 kHz.

In this embodiment, as mentioned, the device may further comprise a second speaker adapted to provide sound into the first end of the acoustic channel.

One manner of providing the spring element(s) is wherein the second opening, in a predetermined plane, has a general cross sectional outline, and wherein the spring element(s), in the plane, extend into the outline.

In this embodiment, preferably, the first part has a shape fitting, in the plane, within the outline, and the second part has a shoulder portion narrowing a cross-sectional dimension of the second part, so that the spring element(s) are adapted to engage the shoulder portion.

According to a particularly advantageous embodiment of the invention, the housing comprises, or is formed in, a metallic material or metallic alloy. A metallic housing is particularly advantageous because it at the same time provides high structural strength for a given housing thickness (for example around 250 μm) and at the same time allows the formation of a spring element directly in the metallic housing material of sufficient strength to provide practical bias forces.

The metallic material or alloy preferably has good magnetic and/or electromagnetic shielding properties to protect the speaker and connector against external EMI. The metallic material or alloy may comprise any of stainless steel, titanium, bulk metallic glass, brass, μ-metal etc. Since at least a portion of the housing may be in direct skin contact with the user's ear canal, a bio-compatible metallic material may advantageously be used.

A practical thickness range for the housing is 50-500 μm such as about 200-300 μm. These dimensions allow the spring element(s) to provide a suitable spring force with practical spring element dimensions. The spring elements are preferably dimensioned to provide a predetermined bias force in the interval 1-10 Newton. Furthermore, the spring elements may advantageously be dimensioned and shaped to provide a retention force of the connector of greater than 15 Newton, or preferably greater than 25 Newton.

Finally, another aspect of the invention relates to a housing for use in the device according to the first aspect of the invention.

BRIEF DESCRIPTION OF THE DRAWINGS

In the following, a preferred embodiment of the invention will be described with reference to the drawing, wherein.

Figure 1:
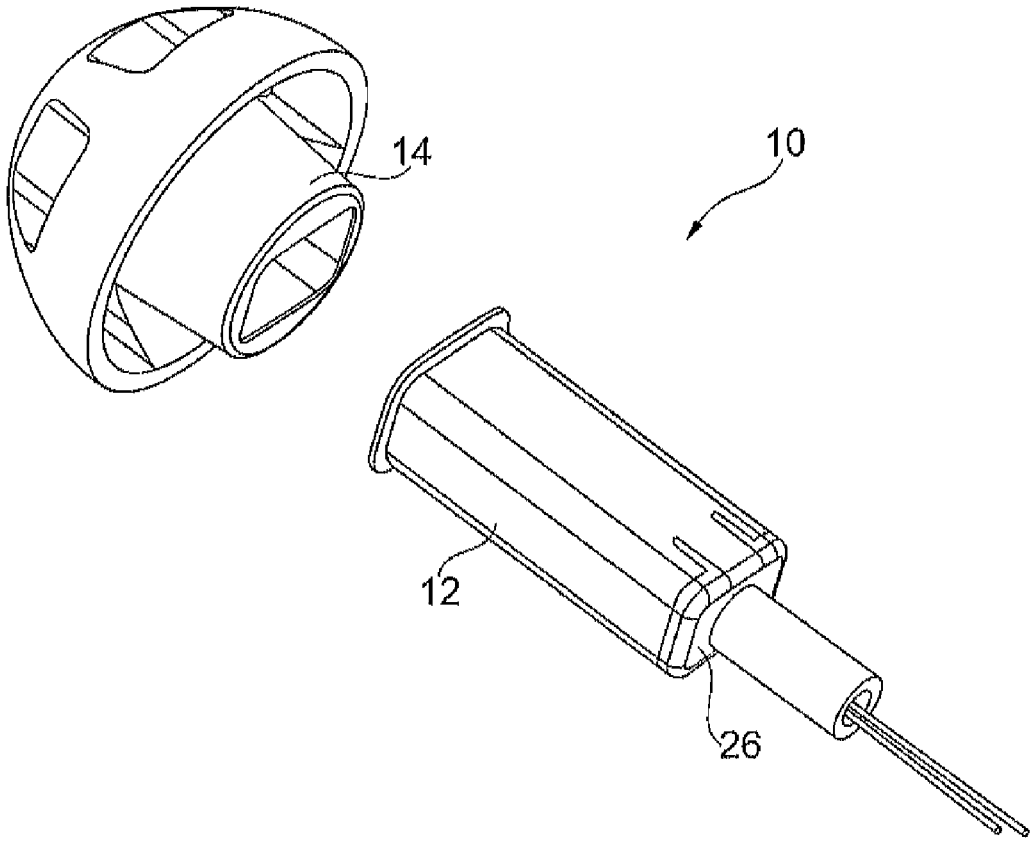
FIG. 1 illustrates a device according to the invention in an assembled state.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

DETAILED DESCRIPTION OF THE INVENTION

Figure 2:
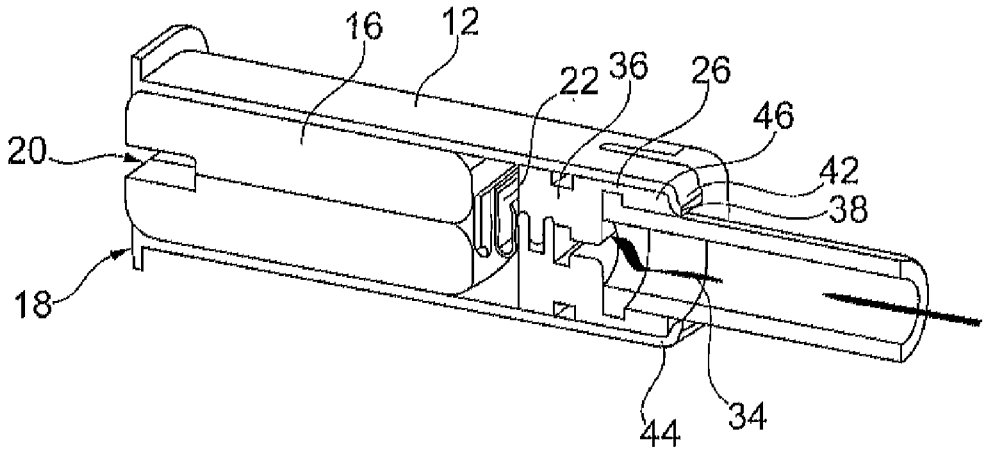
FIG. 2 illustrates the embodiment of FIG. 1 cross-sectional perspective view.

The device 10 in FIGS. 1 and 2 comprises a housing 12 adapted to be positioned in the auditory canal of a person using a moulded element 14 adapted to fix the housing 12 in the canal.

Inside the housing 12 is a speaker 16 extending slightly out of a sound opening 18 of the housing 12. The speaker 16 has a sound output 20 from which sound is emitted when the speaker 16 receives an electrical signal.

In order to receive electrical signals, the speaker 16 has two terminals 22 and 24 presently shaped as U-shaped electrically conducting elements also providing a deformability as will be described further below.

Also, a connector 26 is used being formed of two parts 26' and 26" which are adapted to fix therein two terminals 28 and 30 which are connected to wires 32 and 34 being part of a cable feeding the speaker 16 with electrical signals.

Figure 3:
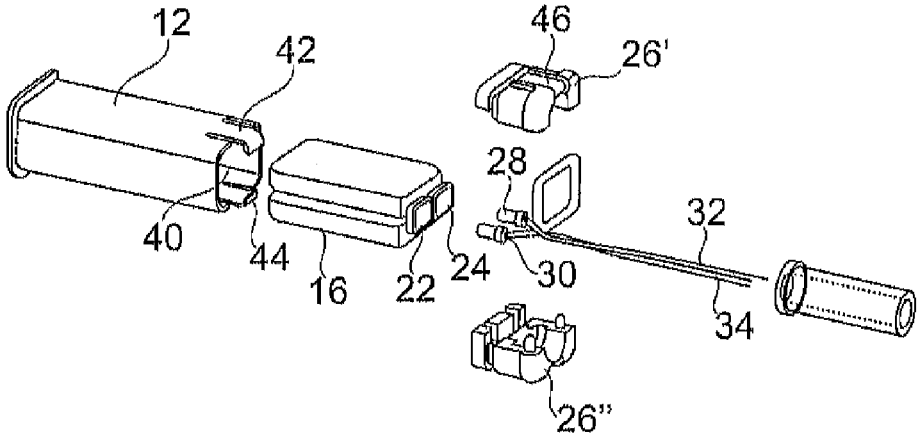
FIG. 3 illustrates the embodiment of FIG. 1 in an exploded view.

From FIG. 3, it is seen that assembling the device 10 is performed by firstly introducing the speaker 16 into the housing 12 via an opening 40 therein, whereafter the assembled connector 26 has a first part 36 thereof comprising the terminals 28/30 fully introduced into the opening 40 so as to obtain contact between the terminals 22/24 and 28/30. When these terminals obtain electrical contact, spring elements 42 and 44 of the housing 12 engage parts 46 of the connector 26 so as to maintain the connector 26 inside the housing 12 while providing a biasing force forcing the terminals 22/24 and 28/30 against each other. The biasing force deforms the terminals 22/24 slightly to ensure a good electrical contact.

The spring elements 42/44 are bent so as to engage the "back" side of the connector 26 so as to prevent the connector 26 from moving out of the housing 12. This also provides the biasing force desired.

Presently, the spring elements 42/44 are made of the same material as the housing 12, which has a number of advantages both in production and as to the size of the overall housing 12. In this situation, it is desired that the housing 12 and spring elements 42/44 are of a metallic material, preferably stainless steel or titanium. This has the advantage of both providing suitable spring forces with a low wall/spring thickness as well as generating desired EMC shielding of the speaker 16.

Naturally, the conductors 32/34 will receive an electrical signal from a provider (not illustrated) in order for the speaker 16 to provide sound.

This provider may additionally provide a sound signal which is transmitted to the connector 26 via a tube or other element which may form part of a cable also comprising the conductors 32/34. The connector 26 may therefore have a sound channel guiding this sound into the housing 12, which may also have a sound channel (not illustrated) guiding the sound from the connector 26 around the speaker 16 and to the sound output 18. If desired, the housing 12 may have a sound mixing chamber (not illustrated) for receiving and mixing sound from the sound output 20 and from the sound channel guiding sound from the connector 26 around the speaker 16 before outputting the mixed sound from the output 18.

The invention claimed is:

1. A detachable earpiece auditory device, comprising:

a housing having a sound outlet, a second opening, and a spring element positioned at the second opening;

a speaker provided within the housing and comprising an electrically conducting speaker terminal at an outer surface of the speaker; and a connector comprising:

a first insert part insertable into the second opening, an electrically conducting connector terminal positioned in the first part and arranged to obtain electrical contact with the electrically conducting speaker terminal so as to form a mating pair of a speaker terminal and a connector terminal, when the first part is inserted into the second opening, and a second insert part in operative contact with the spring element so as to bias the speaker terminal against the connector terminal with a predetermined bias force, wherein the second part is adapted to engage with the spring element so as to bias the connector toward the housing.

2. A detachable earpiece auditory device according to claim 1, wherein the speaker terminal and/or the connector terminal are resilient or translatable in a direction of the predetermined bias force.

3. A detachable earpiece auditory device according to claim 1, wherein the first and second insert parts form part of a unitary structure created by insert moulding together with the electrically conducting connector terminal so as to form a monolithic connector.

4. A detachable earpiece auditory device according to claim 1, further comprising an acoustical sealing ring in abutment to the first and second insert parts and positioned adjacent to the second opening to acoustically seal an interior of the housing toward the external environment.

5. A detachable earpiece auditory device according to claim 1, wherein the connector additionally comprises an acoustic channel having a first opening in the first part and a second opening in the second part, the housing additionally comprising an acoustic path between the second opening and the sound output.

6. A detachable earpiece auditory device according to claim 5, further comprising a second speaker arranged to transmit sound into the first end of the acoustic channel.

7. A detachable earpiece auditory device according to claim 1, wherein the second opening, in a predetermined plane, has a general cross sectional outline, and wherein the spring element(s), in the plane, extend into the outline.

8. A detachable earpiece auditory device according to claim 1, wherein the housing is made of a metal, and wherein the spring element has a thickness in the interval of 50-500 μm.

9. A housing for use in the device according to claim 1.

10. A detachable earpiece auditory device according to claim 1, wherein the speaker terminal and/or the connector terminal are resilient or translatable in a direction of the predetermined bias force.

11. A detachable earpiece auditory device according to claim 1, wherein the first and second insert parts form part of a unitary structure created by insert moulding together with the electrically conducting connector terminal so as to form a monolithic connector.

12. A detachable earpiece auditory device according to claim 1, further comprising an acoustical sealing ring in abutment to the first and second insert parts and positioned adjacent to the second opening to acoustically seal an interior of the housing toward the external environment.

13. A detachable earpiece auditory device, comprising:

a housing having a sound outlet, a second opening, and a spring element positioned at the second opening;

a speaker provided within the housing and comprising an electrically conducting speaker terminal at an outer surface of the speaker; and a connector comprising:

a first insert part insertable into the second opening, an electrically conducting connector terminal positioned in the first part and arranged to obtain electrical contact with the electrically conducting speaker terminal so as to form a mating pair of a speaker terminal and a connector terminal, when the first part is inserted into the second opening, and a second insert part in operative contact with the spring element so as to bias the speaker terminal against the connector terminal with a predetermined bias force, wherein the second part is adapted to engage with the spring element so as to bias the connector along a direction of introduction of the first part of the connector in the housing.

14. A housing for use in the device according to claim 13.

* * * * *